US005115806A

United States Patent [19]

Greuloch et al.

[11] Patent Number: 5,115,806

[45] Date of Patent: * May 26, 1992

[54] CONTINUOUS PASSIVE MOTION DEVICE FOR IMPARTING A SPIRAL MOTION TO THE DIGITS OF THE HAND

[75] Inventors: William Greuloch; Dan Shamir; Mark W. Groves, all of Columbus, Ohio

[73] Assignee: Danninger Medical Technology, Inc., Columbus, Ohio

[ * ] Notice: The portion of the term of this patent subsequent to Oct. 16, 2007 has been disclaimed.

[21] Appl. No.: 471,365

[22] Filed: Feb. 1, 1990

Related U.S. Application Data

[63] Continuation-in-part of Ser. No. 308,437, Feb. 9, 1989, Pat. No. 4,962,756.

[51] Int. Cl.[5] ..... A61H 1/02

[52] U.S. Cl. ..... 128/26; 128/25 R

[58] Field of Search ..... 128/25 R, 77, 48, 57, 128/56, 26, 25 B; 272/69

[56] References Cited

U.S. PATENT DOCUMENTS

| | | | |
|---|---|---|---|
| 4,644,938 | 2/1987 | Yates et al. . | |
| 4,665,900 | 5/1987 | Saringer . | |
| 4,679,548 | 7/1987 | Pecheux . | |
| 4,842,265 | 6/1989 | Kirk | 128/25 B |
| 4,962,756 | 10/1990 | Shamir | 128/26 |

*Primary Examiner*—Richard J. Apley
*Assistant Examiner*—Linda C. M. Dvorak
*Attorney, Agent, or Firm*—Daniel J. Hudak Co.

[57] ABSTRACT

A continuous passive motion device is provided which imparts a reciprocating spiral motion to one or more fingers of a user. The device can also be adapted for use with a thumb. The motion is achieved by linking a rotary motion of the device to a linear motion with respect to the device of a linear actuator.

10 Claims, 5 Drawing Sheets

CONTINUOUS PASSIVE MOTION DEVICE FOR IMPARTING A SPIRAL MOTION TO THE DIGITS OF THE HAND

CROSS-REFERENCE

This application is a continuation-in-part of co-pending U.S. patent application Ser. No. 07/308,437, filed Feb. 9, 1989, for "Continuous Passive Motion Device for Imparting a Spiral Motion to the Digits of the Hand," Dan Shamir and Mark W. Groves, inventors, now U.S. Pat. No. 4,962,756.

FIELD OF THE INVENTION

The present invention relates to a continuous passive motion (CPM) device to cause passive motion of the digits of a hand, and more particularly to a device which causes a spiral motion of the digits to achieve complete flexion and extension of each of the flange joints.

BACKGROUND

It has been recently discovered that passive motion of a joint reduces the post-trauma accumulation of fluid and subsequently reduces the recovery time. This form of therapy has received acceptance as an advantage to the patient and a cost savings in the health care field. In particular, devices are commercially available to produce movement in the hip, knee, and ankle. A limited number of devices are available to produce movement in the digits of a hand. The problems in designing such hand devices are that the movement of the fingers and thumb are very complex and the distance traveled is relatively small. Thus, it is difficult to design a machine which is not cumbersome and heavy, and which will achieve the desired motion. It is also a problem to design such a device which is not too complex and that will stand up to the rigors of continuous use.

U.S. Pat. No. 4,644,938 issued Feb. 24, 1987 to Lubbers relates to a device to cause continuous passive motion of the hand. The device operates using an elastic biasing force which tends to pull the finger into a flexed position and a counter force which is intermittently applied to overcome the biasing force and pull the fingers into an extended position.

U.S. Pat. No. 4,665,900 issued May 19, 1987 to Saringer relates to a device mounted on the palmar side of the forearm. The device uses an elongated rod to push and pull the finger in and out of flexion and extension.

U.S. Pat. No. 4,679,548, issued Jul. 19, 1987, to Pecheux, relates to a continuous passive motion device for use with a hand where portions of the apparatus move in a spiral motion which is performed by a single, motor-driven slide guide.

The present invention provides an elegant and durable mechanism to cause continuous passive motion of one or more digits and further a mechanism which approximates the spiral motion traveled at a point near the distal end of a digit to achieve complete flexion and extension.

Further objects and advantages of the invention may be presented and discussed hereinafter.

SUMMARY OF THE INVENTION

A portable CPM machine is presented for causing controlled continuous passive motion of one or more of the digits of a patient's hand. In a first embodiment, the device is mounted on the dorsal surface of the hand for motion of the four fingers and is mounted on the palmar aspect of the forearm for motion of the thumb. The thumb use is independent of finger use in that the device is mounted in a different location and the axis of rotation is about a line which is perpendicular to the frontal or sagittal plane of the forearm. The mounting for use with the thumb has the device mounted on the palmar surface of the forearm parallel to the longitudinal axis of the forearm. In both instances, the device is supported by a splint on the user's hand which extends along the forearm. The device has a housing with an actuating mechanism located within the housing. In the first embodiment, the actuating mechanism comprises a reciprocating linear actuator which is linked to a rotary actuator so that for finger use the device is rotated about an axis located on the user's hand and transverse to the longitudinal axis of the user's arm and simultaneously an actuating arm which is linked to one or more digits driven back and forth. This actuating mechanism achieves a spiral motion which is imparted to the end of the digit or digits in therapy. The motion of the actuating arm allows for flexion and extension of each of the digital flanges. A spiral motion is imparted to the thumb in a plane parallel to the frontal plane of the user's hand as the device is rotated about an axis substantially transverse to the frontal plane and the actuating arm undergoes reciprocation.

In a second embodiment, the spiral motion is achieved by use of a two-part linkage having an intermediate axis rotation and the whole linkage being driven about an axis which is fixed relative to the user's hand.

DETAILED DESCRIPTION OF THE INVENTION

Figure 1:
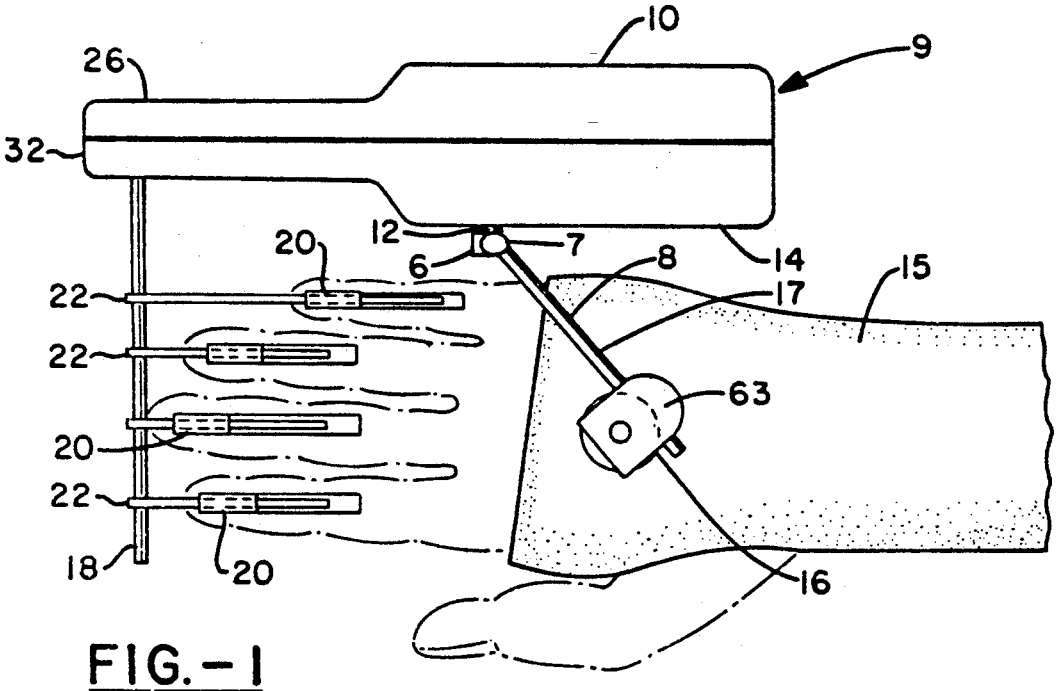
FIG. 1 shows a top view of the first embodiment of the device in accordance with the invention mounted on the ulnar aspect of a user's hand for use on the fingers.
Figure 2:
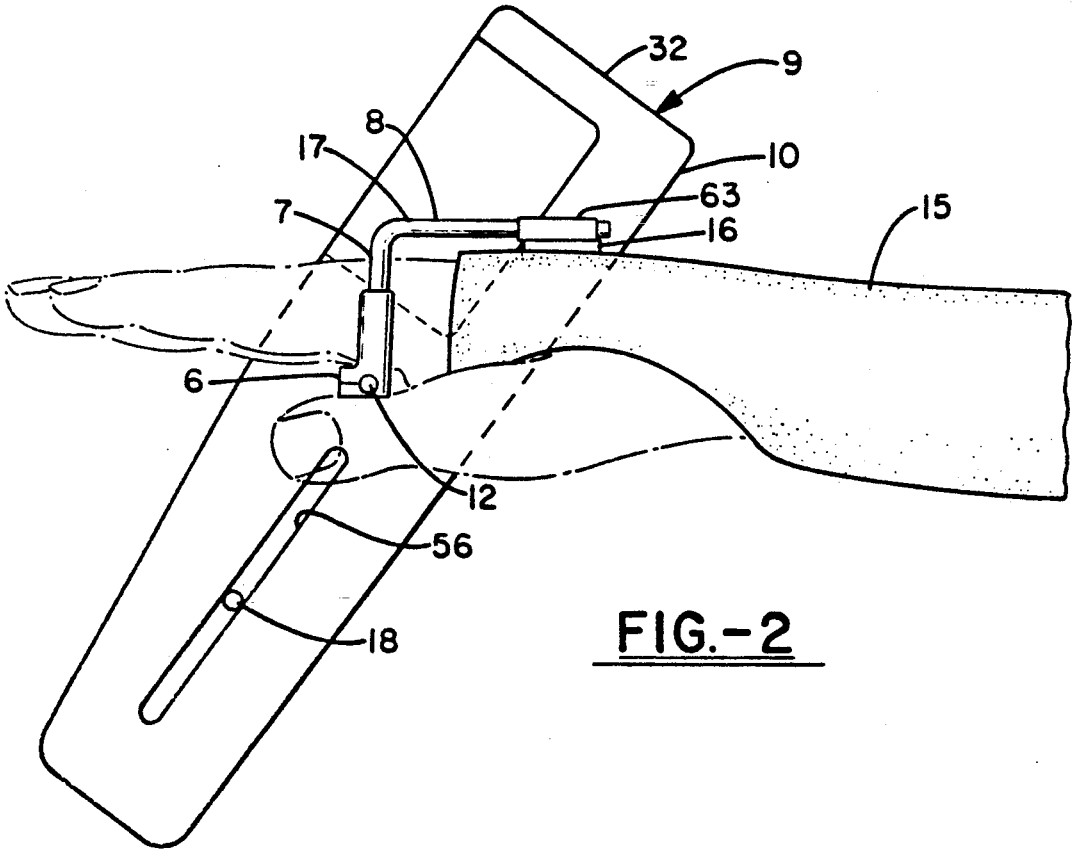
FIG. 2 shows a side view of the first embodiment of the CPM device mounted on the ulnar aspect of a user's hand for use with the fingers.
Figure 5:
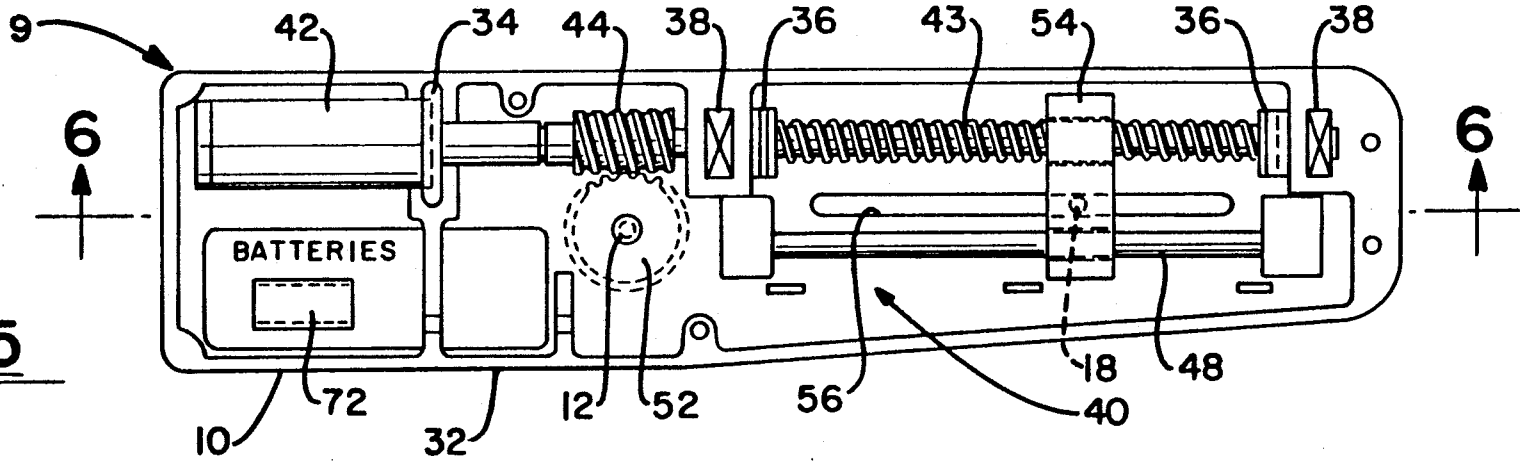
FIG. 5 shows a top plan view of the first embodiment of the CPM device with the cover of the housing removed to show the actuating mechanism.

The first embodiment of the CPM device of the present invention is shown generally at 9 as it is mounted on the arm for finger use, and in particular on the ulnar aspect of the hand and forearm of the user. The device includes a housing 10 which is mounted from a rotator shaft 12 which extends from a lateral side 14 of the housing 10. The rotator shaft 12 engages a mount 16 which is attached to the dorsal side of a splint or support 15 which engages the user's hand and forearm for finger use.

The mount 16 for use with the finger use comprises a pivot arm 17 having a first clamp 6 which has an axis located anterior to the user's hand, a transverse first length 7, and a second length 8 transverse to the first length and which has an acute interior angle with respect to the axis of the first clamp. The second length 8 engages a second pivot clamp 63 located on the dorsal side of the user's hand and attached to the splint 15. The second length 8 can be axially adjusted in the second clamp, and likewise the anterior angle can be adjusted by rotating the clamp 63. Likewise the height of the first clamp 6 can be adjusted on the first length 7 of the pivot arm. The position of this clamp can be subsequently locked by a locking ring. The mount 16 is adjusted so that the axis of rotation corresponds to the axis defined when the fingers are curled into the palm as if to grasp a rod. The position of the mount is subsequently locked. Thus, the mount can be adjusted to compensate for the various shapes and sizes of hand with which it will be used.

The rotator shaft 12 constitutes an axis of rotation which is transverse to the medial, i.e. the longitudinal plane of the user's arm. When the device is in use, it rotates about the rotator shaft 12.

Spaced apart from the rotator shaft 12 is an actuating arm 18 which extends substantially parallel to the rotator shaft 12. The actuating arm 18 operatively engages one or more of the digits of the user by means of one or more finger attachments 20 which have a bearing surface 22 that captures the end of the actuating bar 18. The finger attachments 20 also include an intermediate telescoping portion operatively joined to a base which is adhered to the finger of the user. The telescoping finger attachments permit a straight actuating bar 18 to be used to drive all of the fingers through flexion and extension although the fingers are of varying length.

The housing 10 is made of an injected plastic, such as an acrylonitrile-butadiene-styrene terpolymer ("ABS"), and includes a first section 26 and a second section 32. The first and second sections 26 and 32 are made to form the housing 10 which contains the actuating mechanism 40. The housing 10 is molded so that it may include integral functional elements For example, a motor 42 is mounted in a motor mount section 34 of the housing. The motor 42 is a battery driven electrical motor which is driven by two 1.5 batteries. The motor 42 engages a drive screw such as an Acme screw 43 which is mounted in thrust bushings and journal bearings 36 and 38 mounted in the housing 30.

Figure 6:
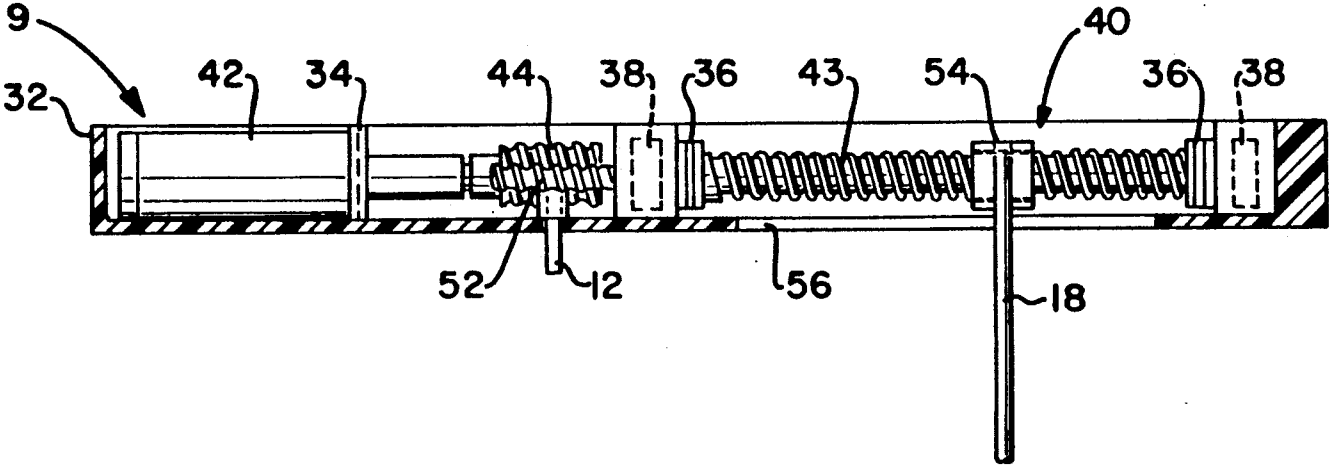
FIG. 6 shows a cross-section at line 1—1 of FIG. 5.
Figure 7:
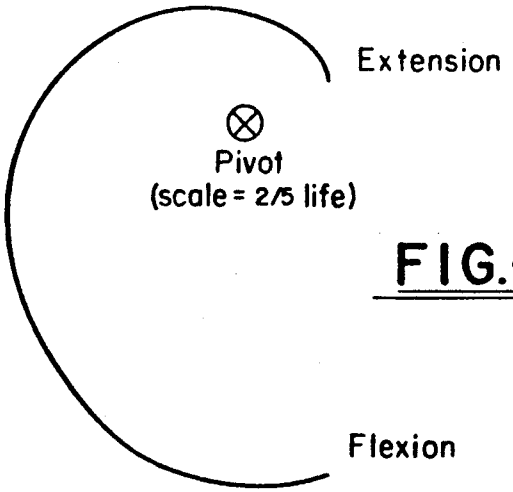
FIG. 7 shows a reduced scale spiral curve which is the motion achieved at the link between the actuating bar and the finger by the device of the present invention.

The motor also engages a worm 44 which engages a worm gear 52 which is attached to the rotator shaft 12 and the worm 44 rotates about the worm gear 52 and the transverse axis of rotation, i.e., the axis defined by rotator shaft bar 12. Thus, when the motor 42 drives the Acme screw 43 and the worm 44 about the worm gear 52, the device 9 is rotated about the axis of the rotator shaft 12. Simultaneously, a traveler 54 which engages the Acme screw 43 is driven in linear reciprocation by the rotation of Acme screw 43. The traveler also engages a bearing beam 48. The traveler 54 travels back and forth on the Acme screw 43 and reverses when the motor reverses. The actuating arm 18 is carried by the traveler and extends from the traveler through a slot 56 in the cover 32 to the finger of the user. The linkage of the linear and the rotary actuation causes the actuating arm 18 to be rotated in a spiral motion as illustrated in reduced scale in FIG. 6. The actuating arm, which is attached to the fingers by the telescoping finger attachments then causes the fingers to be pushed into flexion and pulled into extension following the spiral path. The spiral motion approximates the natural motion of the digits as they are moved through flexion and extension by the user. The motion exercises each of the flanges of the digit as it is moved through flexion and extension. This is an extreme advantage in recuperative therapy.

The length of travel of the traveler along the Acme screw is controlled by a solid state relay circuit 72. Thus, when the desired limit of the flexion is encountered, the relay reverses the direction of the motor and consequently the direction of the rotation of the Acme screw as well as rotation of the housing about the rotator shaft 12. Further, it can be seen that the shape of the spiral, i.e. ratio of the rotational aspect to the linear aspect of motion, can be controlled by the gearing of the worm gear 52.

Figure 4:
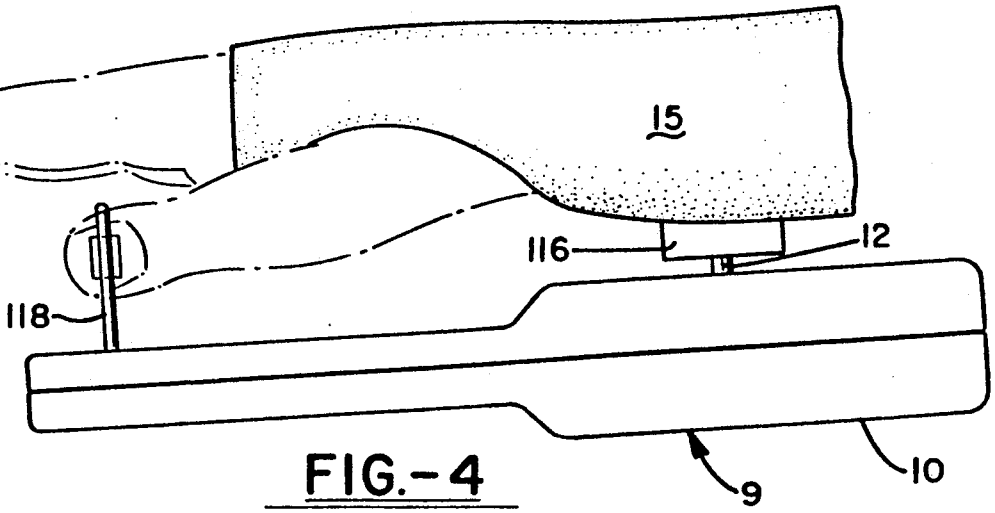
FIG. 4 shows a side view of the first embodiment of the device mounted on the palmar aspect of the user's hand for use on the thumb.
Figure 3:
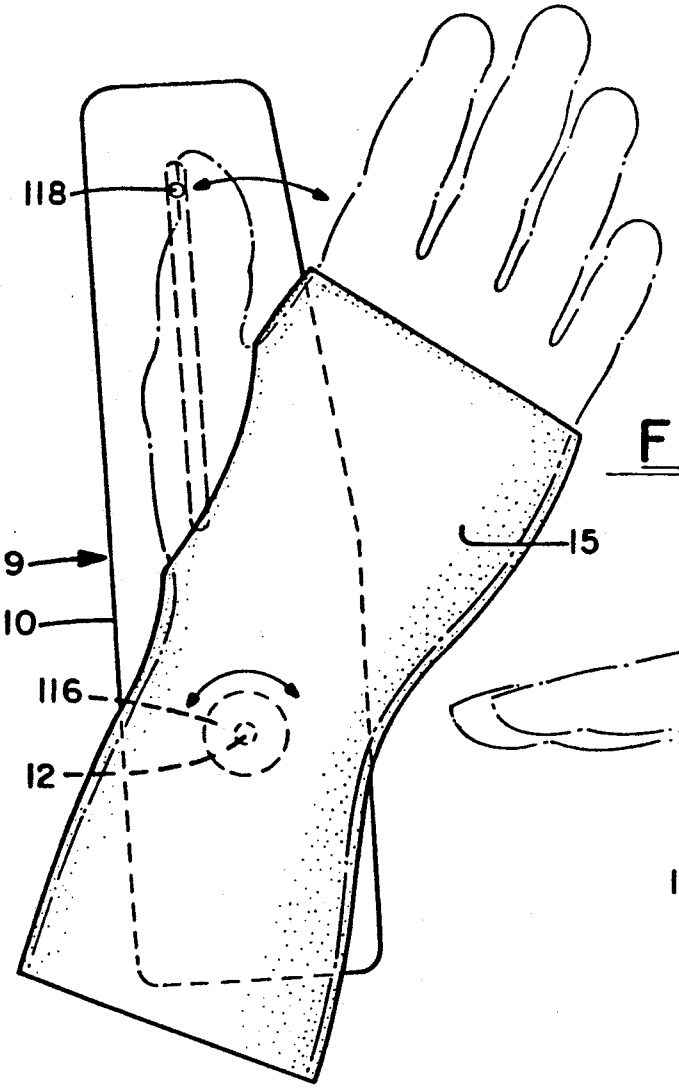
FIG. 3 shows a bottom view of the first embodiment of the device mounted on the palmar aspect of the user's hand for use on the thumb.
Figure 8:
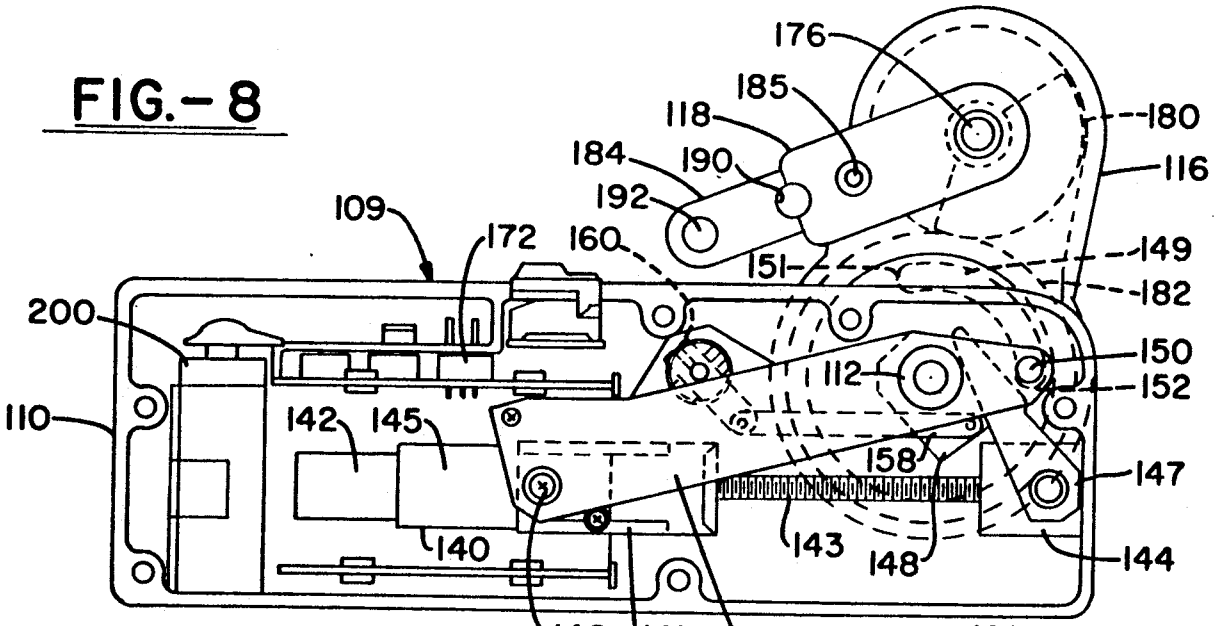
FIG. 8 shows a side plan view of the second embodiment of the CPM device with the cover of the housings removed to show the actuation mechanism as it appears with the finger in flexion.
Figure 9:
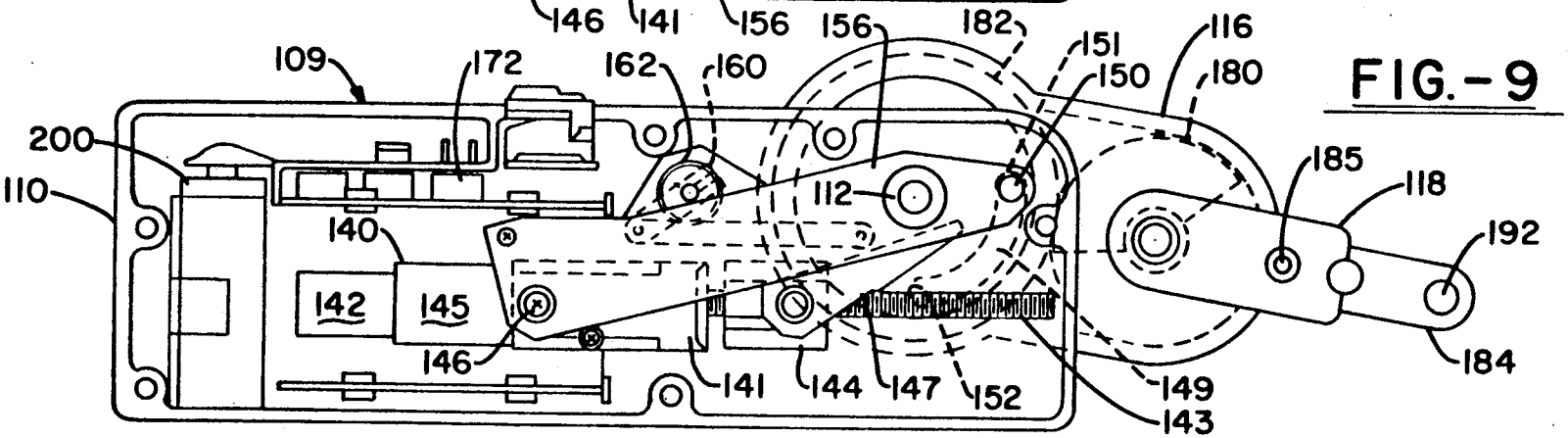
FIG. 9 shows a side plan view of the second embodiment of the CPM device with the cover other housing removed to show the actuation device as it appears with the fingers in extension.
Figure 10:
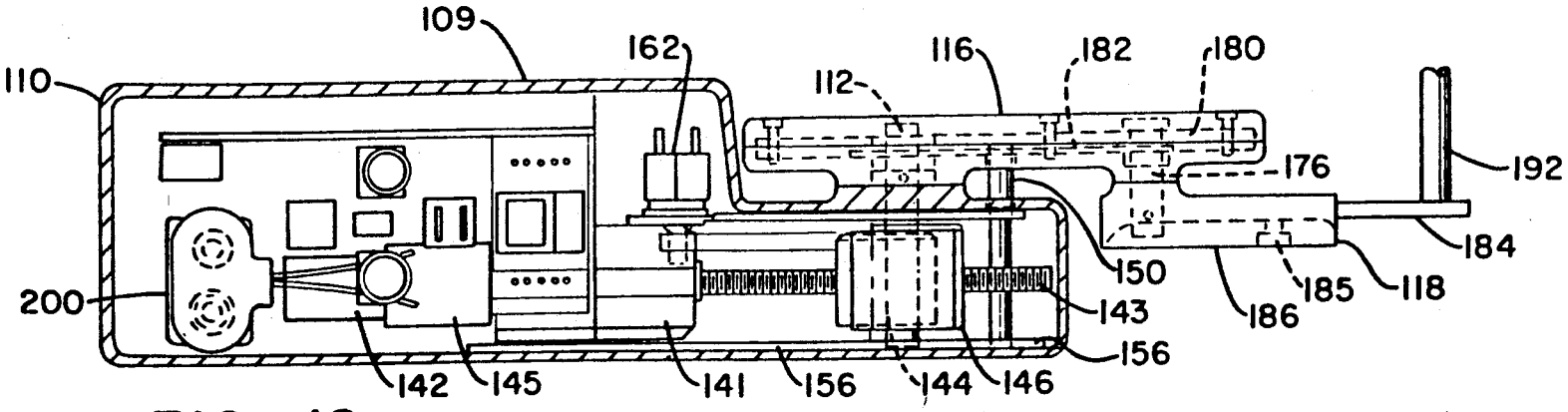
FIG. 10 shows a top plan view of the CPM device.
Figure 11:
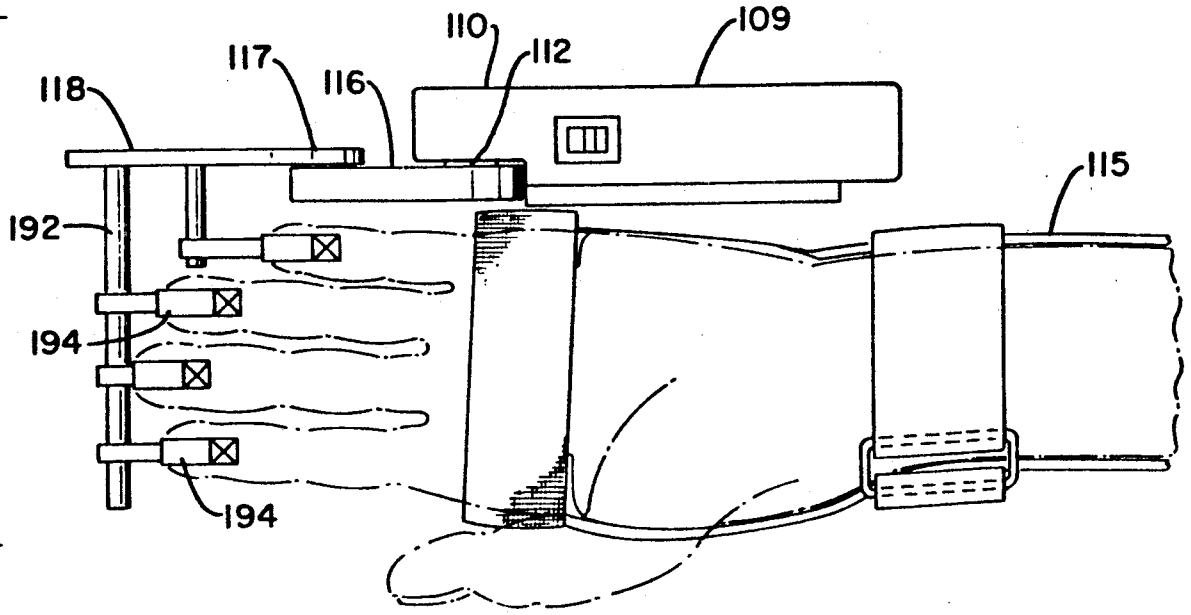
FIG. 11 shows a top view of the CPM device of the present invention, mounted to a user's hand.

As is shown in FIG. 3 and FIG. 4, the device is mounted on the palmar aspect of the forearm for motion of the thumb. The device thus rotates in a plane parallel to the plane of the user's hand about an axis transverse to the plane. The thumb is drawn by a finger attachment through a spiral which is shortened from that traveled when the device is used on the fingers. For use with the thumb, the device is attached to a mount 116 on the palmar side of the splint. The mount 116 comprises a splint pivot clamp 106 which engages the rotator shaft 12. The actuating arm 118 is shortened so as to preclude interference with the fingers.

As an alternative embodiment of the invention, the linear actuator could comprise a belt drive. Of course, it should be understood that the belt drive can be a toothed-belt or a linked chain. Similarly, the motor may be mounted outside the housing on a axis parallel to the pivot bar and appropriate gearing may be used to drive the actuators.

The batteries used to drive the motor are mounted in a compartment 60 in the housing 10 and are thus concealed.

The relay circuit further includes a reversing mechanism so that the motor will reverse upon encountering a preset load as a further means of protecting the user from over-stressing the user's fingers.

The second embodiment of the CPM device of the present invention is shown generally at 109 in FIGS. 8–11. The device includes a housing 110 which is mounted to a splint or support 115 which engages the user's hand and forearm. In this embodiment, the housing 110 is stationary with respect to the splint 115 and is removably joined to it such as through the use of intermeshing Velcro® strips 112. The housing 110 is mounted along the lateral edge of the user's hand.

In this embodiment, the CPM device has a two-part linkage 117 which drives the user's finger or fingers through the spiral path. The two-part linkage 117 is comprised of an inner arm 116 and an outer arm 118. The inner arm is joined to the CPM housing at an axis rod 112 which extends through an opening in the housing. The axis rod 112 is driven through an arc through the translation of linear actuation to angular actuation. In particular, a motor 142 drives a ball screw shaft 143 which drives a ball screw nut or traveler 144 in linear reciprocating motion along the ball screw shaft 143. In fact, the motor 142 is linked to a motor gear box 145 and to corresponding motor mount blocks 141. The motor assembly 140 which consists of the motor, the motor gear box and tire motor mount blocks, is held in position relative to the housing 110 by the pivot 146. This construction allows the motor assembly 140 and the ball screw to gimble from about 0° to about 15° as the unit drives the digit through flexion and extension. A pivot arm 147 is pivotally joined to the traveler 144 and is fixed in relation to a block 148 which rotates as the traveler 144 is driven by the motor 142. The block 148, in turn, rotates the axis rod 112 and correspondingly the inner arm 116. The respective edges of the slot 151,152 define the limits of flexion and extension and thus provide a safety mechanism to prevent over-extension.

The axis rod 112 is held in position relative to the housing 110 by mount brackets 156. The angular position of the block 148 is determined by link 158 which drives a slotted arm 160 that engages a potentiometer 162. The length of travel of the traveler along the ball screw 143 is controlled by a solid state relay circuit 172 which is fed information from the potentiometer 162. Thus, when the desired limit of flexion is encountered, the relay reverses the direction of the motor and, consequently, the direction of rotation of the linkage 117. The motor speed can also be determined by use of appropriate circuitry and motor gearing.

Further, outer arm 118 is linked to the inner arm 116 about pivot 176 linked to a toothed gear 180 that meshes with and is driven by a corresponding toothed gear 182 in the inner arm 116. The gear 182 is fixed in position relative to the housing 110 by pin 150 which extends through slot 149. Thus, as the inner arm 116 is rotated, the outer arm 118 is driven about the pivot 176. Thus, the distal end of the outer arm rotates about an axis within the inner arm and consequently defines a spiral about the axis rod 112. The outer arm 118 includes an outer member 184 which is held in position by a spring-loaded pin 185 that engages holes 190 within the outer member 184. The pin 185 secures the position of the outer member 184 as it telescopes with the inner member 186 so that the length of the outer arm 118 can be varied to accommodate the finger length of the user.

The outer arm 118 includes a transverse drive rod 192 which engages telescoping finger mounts 194. The finger mounts 194 encircle the rod 192 rotate freely relative to the axis of the rod. Further, the finger mounts include spring-loaded telescoping first and second members biased outwardly by the spring.

Thus it can be seen that the CPM device of the second embodiment further describes a relatively light and compact device which can be mounted on the user's hand and which drives the fingers through a spiral and is consequently anatomically correct.

While in accordance with the Patent Statutes, the best mode and preferred embodiment has been set forth, the scope of the invention is not limited thereto, but rather by the scope of the attached claims.

What is claimed is:

1. A portable device for causing motion of a distal point on a user's hand comprising:

an actuator capable of being mounted on and substantially supported by a user's arm and having an axis of rotation, a link operatively joining said actuator to at least a point on said user's hand, said point being spaced from said axis of rotation, whereby engagement of said actuator causes said point to travel in a spiral about said axis of rotation.

2. A device as set forth in claim 1, wherein said device is adapted for passive flexion and extension of a user's digit and said point is located on said digit.

3. A device as set forth in claim 2, wherein said actuator is contained within a housing having a lateral edge, said lateral edge being substantially aligned with the lateral edge of the user's hand, and said link comprises a rod which extends transverse to the longitudinal axis of said actuator, said rod being joined to a distal portion of said digit.

4. A device for causing passive flexion and extension of a user's digit, comprising;

a motor driven actuator operatively linked to cause said flexion and extension of said digit by a two member linkage comprising an inner arm which is driven in angular reciprocation in an arc about an axis by said actuator, and an outer arm which is rotatably linked to said inner arm such that a distal end of said outer arm describes a spiral about said axis.

5. A device as set forth in claim 4, wherein said device is portable and can be fully supported on the user's forearm and hand.

6. A device as set forth in claim 5, wherein said distal end of said outer arm is linked to a transverse bar, said transverse bar having at least one finger mount rotatably mounted thereon and linking said transverse bar to said digit.

7. A device as set forth in claim 1, wherein said device includes a finger mount having a first member which telescopes within therefore second member and is biased outwardly by a spring.

8. A device as set forth in claim 6, wherein said outer arm has an adjustable length.

9. A device as set forth in claim 8, wherein said actuator comprises a linear actuator linked to a rod axially aligned with said axis.

10. A portable device for causing motion of a distal point on a user's finger comprising:

an actuator capable of being mounted and substantially supported by a user's arm and having an axis of rotation, p1 a link operatively joining said actuator to at least a point on a user's finger, said point being spaced from said axis of rotation whereby engagement of said actuator causes said finger to undergo flexion and extension; and said link including a finger mount pivotally attached to said finger and having a rigid first member and a rigid second member, and said first member operating cooperatively with said second member and being biased outward of said second member by spring means.

* * * * *